US009842541B2

(12) United States Patent
Shin

(10) Patent No.: US 9,842,541 B2
(45) Date of Patent: Dec. 12, 2017

(54) ORGANIC LIGHT-EMITTING DISPLAY PANEL, ORGANIC LIGHT-EMITTING DISPLAY APPARATUS, AND VOLTAGE DROP COMPENSATING METHOD

(71) Applicant: SAMSUNG DISPLAY CO., LTD., Yongin-si, Gyeonggi-Do (KR)

(72) Inventor: Dongyong Shin, Yongin-si (KR)

(73) Assignee: SAMSUNG DISPLAY CO., LTD., Yongin-Si, Gyeonggi-do (KR)

( * ) Notice: Subject to any disclaimer, the term of this patent is extended or adjusted under 35 U.S.C. 154(b) by 157 days.

(21) Appl. No.: 14/845,303

(22) Filed: Sep. 4, 2015

(65) Prior Publication Data

US 2016/0260383 A1 Sep. 8, 2016

(30) Foreign Application Priority Data

Mar. 6, 2015 (KR) ..... 10-2015-0031969

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01);
(Continued)

(58) Field of Classification Search
CPC ..... G09G 2320/0233; G09G 2330/028; G09G 3/3233; G09G 2300/0426; G09G 3/3258;
(Continued)

(56) References Cited

U.S. PATENT DOCUMENTS

2003/0006976 A1* 1/2003 Sagano ..... G09G 3/22 345/204
2004/0252117 A1* 12/2004 Tanada ..... G09G 3/32 345/212

(Continued)

FOREIGN PATENT DOCUMENTS

KR 10-2005-0022993 A 3/2005
KR 10-2006-0031550 A 4/2006

(Continued)

OTHER PUBLICATIONS

Extended European Search Report dated Jun. 6, 2016 in Corresponding European Patent Application No. 16158742.3.

*Primary Examiner* — Koosha Sharifi-Tafreshi
(74) *Attorney, Agent, or Firm* — Lee & Morse, P.C.

(57) ABSTRACT

An organic light-emitting display panel includes a power input line, a power transfer line, and first and second power wires. The power input line extends in a first direction of a display area and applies a first source voltage. The power transfer line extends in the first direction, is connected to a center point of the power input line, and transfers the first source voltage to the power input line. The first power wire and second power wire extends in a second direction outside the display area and supply the first source voltage to the power input line and the power transfer line. A plurality of pixels are arranged in a matrix in the display area and are connected to the power input line to receive the first source voltage through the power input line.

12 Claims, 9 Drawing Sheets

(52) U.S. Cl.
CPC ..... *G09G 2300/0814* (2013.01); *G09G 2320/0204* (2013.01); *G09G 2320/0223* (2013.01)

(58) Field of Classification Search
CPC ..... G09G 2320/0223; G09G 2330/00; G09G 2330/02; G09G 2300/0809; G09G 2300/0842; G09G 2330/021; G09G 3/2022; G09G 3/3208
USPC ..... 345/76, 211, 77, 212, 690, 78, 83
See application file for complete search history.

(56) References Cited

U.S. PATENT DOCUMENTS

2005/0057461 A1 3/2005 Suh et al.
2005/0083270 A1* 4/2005 Miyazawa ..... G09G 3/3233 345/76
2010/0149162 A1 6/2010 Park et al.
2011/0007054 A1* 1/2011 Kim ..... G09G 3/3208 345/211
2011/0242087 A1* 10/2011 Ebisuno ..... G09G 3/3233 345/212
2012/0249514 A1* 10/2012 Ahn ..... G09G 3/3233 345/212
2012/0327067 A1* 12/2012 Kato ..... G09G 3/3258 345/212
2013/0181966 A1 7/2013 Jeong et al.
2014/0091992 A1 4/2014 Lee et al.
2014/0368416 A1 12/2014 Gu et al.

FOREIGN PATENT DOCUMENTS

KR 10-2010-0068075 A 6/2010
KR 10-2013-0083722 A 7/2013
KR 10-2014-0042183 A 4/2014

* cited by examiner

ORGANIC LIGHT-EMITTING DISPLAY PANEL, ORGANIC LIGHT-EMITTING DISPLAY APPARATUS, AND VOLTAGE DROP COMPENSATING METHOD

CROSS-REFERENCE TO RELATED APPLICATION

Korean Patent Application No. 10-2015-0031969, filed on Mar. 6, 2015, and entitled, "Organic Light-Emitting Display Panel, Organic Light-Emitting Display Apparatus, and Voltage Drop Compensating Method," is incorporated by reference herein in its entirety.

BACKGROUND

1. Field

One or more embodiments described herein relate to an organic light-emitting display panel, an organic light-emitting display apparatus, and a voltage drop compensating method.

2. Description of the Related Art

An organic light-emitting display apparatus generates images using a plurality of pixels. Each pixel includes an organic light-emitting diode that emits light based on a recombination of electrons and holes in an emitting layer. This type of apparatus has fast response times and low consumption power.

In terms of structure, the organic light-emitting display apparatus may include a plurality of gate lines, a plurality of source lines, and a plurality of power lines connected to the pixels arranged in a matrix form. The pixels may be driven by an analog driving scheme. In this case, the pixels emit light of various grayscale values by adjusting brightness according to levels of voltage or current data. Alternatively, the pixels may be driven by a digital driving scheme. In this case, the pixels emit light of different grayscale values based on different emission times.

In operation, a voltage drop (or IR drop) may occur in the power lines. The voltage drop may be caused by relatively higher-level current flowing in each of the power lines and resistance components of the power lines. In an attempt to offset this voltage drop, source voltages having different voltage levels may be respectively applied to pixels depending on locations of the pixels. However, due to the different voltage levels, the pixels may emit light at the desired brightness.

SUMMARY

In accordance with one or more embodiments, an organic light-emitting display panel includes a power input line extending in a first direction of a display area, the power input line to apply a first source voltage; a power transfer line extending in the first direction and connected to a center point of the power input line, the power transfer line to transfer the first source voltage to the power input line; a first power wire and a second power wire extending in a second direction outside the display area, the first power wire and the second power wire to supply the first source voltage to the power input line and the power transfer line; and a plurality of pixels arranged in a matrix in the display area and connected to the power input line to receive the first source voltage through the power input line.

The pixels may be indirectly connected to the power transfer line. A level of the first source voltage, which is supplied to a plurality of pixels arranged closest to the first power wire or the second power wire, may be higher than a level of the first source voltage supplied to pixels connected to the center point of the power input line.

The pixels are may be supplied with a second source voltage having a lower voltage level than a level of the first source voltage. The power input line may be electrically connected to the power transfer line through a connection part. Each of the pixels may include a pixel circuit and a light-emitting device that includes a first electrode connected to the pixel circuit and a second electrode to which the second source voltage is applied. The first electrode may be an anode electrode, and the second electrode may be a cathode electrode.

The pixel circuit may include a first thin film transistor to be turned on by a scan signal applied through a gate line and to transfer a data signal applied through a source line; a second thin film transistor to be turned on according to a logic level of the data signal and to transfer the first source voltage to the light-emitting device; and a capacitor to maintain a turn-on state or a turn-off state of the second thin film transistor based on a logic level of the data signal during a subfield time period.

In accordance with one or more other embodiments, an organic light-emitting display apparatus includes a source voltage generator to generate a first source voltage and a second source voltage having a lower voltage level than a level of the first source voltage; and an organic light-emitting display panel which includes: a power input line extending in a first direction of a display area, the power input line to apply a first source voltage; a power transfer line extending in the first direction and connected to a center point of the power input line, the power transfer line to transfer the first source voltage to the power input line; a first power wire and a second power wire extending in a second direction outside the display area, the first power wire and the second power wire to supply the first source voltage to the power input line and the power transfer line; and a plurality of pixels arranged in a matrix form in the display area and connected to the power input line to receive the first source voltage through the power input line. The pixels may be indirectly connected to the power transfer line.

In accordance with one or more other embodiments, a voltage drop compensating method is provided for an organic light-emitting display panel that includes a power input line extending in a first direction and through which a source voltage is applied, a power transfer line extending in the first direction and connected to a center point of the power input line to transfer the source voltage to the power input line, and first and second power wires which supply the source voltage to the power input line and the power transfer line. The method includes disconnecting the power transfer line from the first and second power wires; measuring a level of a voltage applied to the power transfer line; connecting the first and second power wires to the power transfer line and disconnecting the first and second power wires from the power input line; measuring a level of a voltage at one end of the power input line; and calculating a ratio of a resistance value of the power transfer line to a resistance value of the power input line.

Calculating the ratio may include calculating the ratio based on a difference between the source voltage and the voltage, which is measured in measuring the level of the voltage applied to the power transfer line, and a difference between the source voltage and the voltage which is measured in measuring the level of the voltage at the one end of the power input line.

In accordance with one or more other embodiments, a voltage drop compensating method is provided for an organic light-emitting display panel that includes a power input line extending in a first direction and through which a source voltage is applied, a power transfer line extending in the first direction and is connected to a center point of the power input line to transfer the source voltage to the power input line, a voltage measurement line that measures a voltage at the center point of the power input line, and first and second power wires which supply the source voltage to the power input line and the power transfer line. The method includes measuring a resistance of the power transfer line; measuring the voltage at the center point of the power input line using the voltage measurement line; measuring a level of a current which flows through the power input line; and calculating a ratio of a resistance value of the power transfer line to a resistance value of the power input line.

Calculating the ratio may include calculating the ratio based on the following Equation:

$$ELVDD - ELVDD_{center} = \frac{aV_D}{2(a+1)}$$

where ELVDD denotes the source voltage, $ELVDD_{center}$ denotes the voltage measured in measuring the voltage, $V_D$ denotes a voltage calculated using a resistance of the power transfer line and the current measured in measuring the level of the current, and a denotes the ratio.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
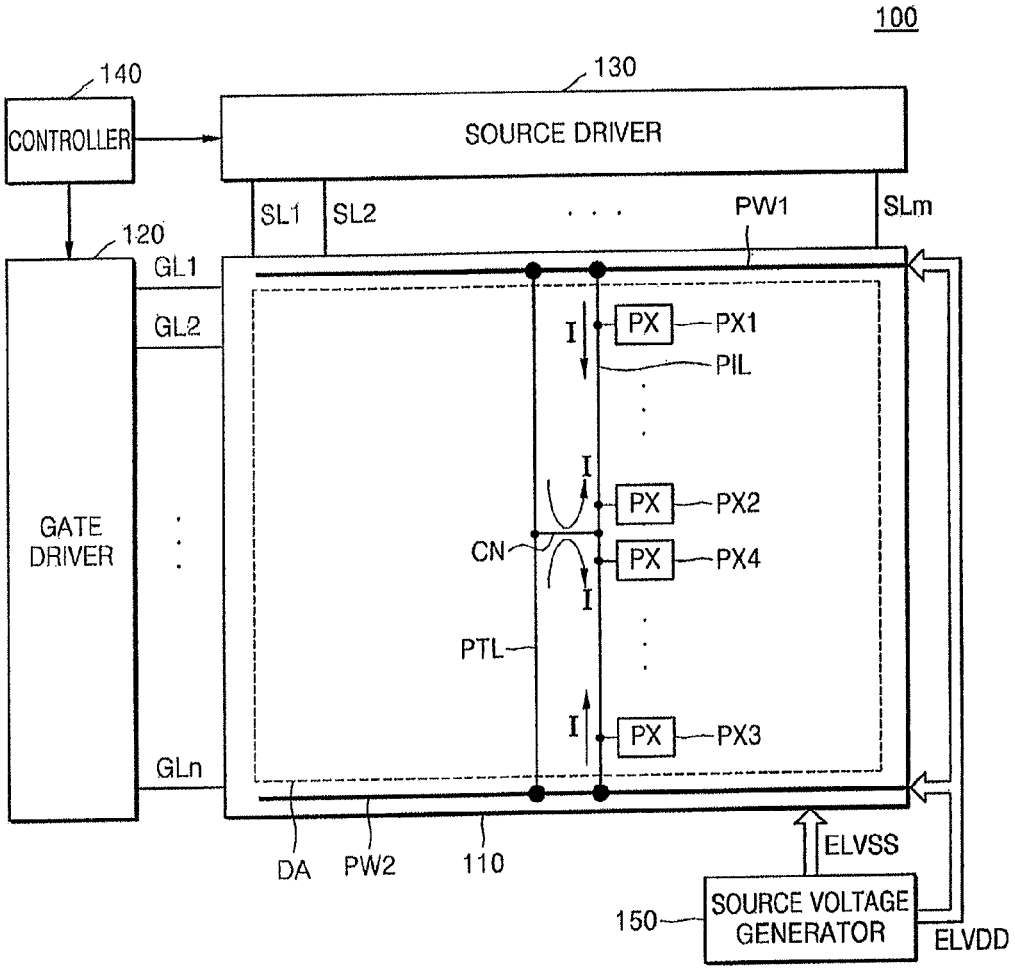
FIG. 1 illustrates an embodiment of an organic light-emitting display apparatus.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

FIG. 1 illustrates an embodiment of an organic light-emitting display apparatus 100 which includes a display panel 110, a gate driver 120, a source driver 130, a controller 140, and a source voltage generator 150.

The display panel 110 includes a display area DA having a plurality of pixels PX arranged in a matrix form. A first source voltage ELVDD and a second source voltage ELVSS may be applied to the pixels PX. A voltage level of the first source voltage ELVDD may be higher than that of the second source voltage ELVSS. For example, when the first source voltage ELVDD is applied to an anode of an organic light-emitting device and the second source voltage ELVSS is applied to a cathode of the organic light-emitting device, the organic light-emitting device may emit light. The first source voltage ELVDD and the second source voltage ELVSS may be generated by the source voltage generator 150.

The display panel 110 also includes a plurality of gate lines GL1 to GLn through which a gate signal is applied to the pixels PX, and a plurality of source lines SL1 to SLm through which source signals are respectively applied to the pixels PX. The display panel 110 may include a power wire network for applying the first source voltage ELVDD to the pixels PX. Each of the gate lines GL1 to GLn is connected to a plurality of pixels PX arranged in the same row. Each of the source lines SL1 to SLm is connected to a plurality of pixels PX arranged in the same column. In response to the gate signal received through the gate lines GL1 to GLn, the pixels PX emit light or do not emit light according to logic levels of data signals respectively received through the source lines SL1 to SLm. In this case, the display panel 110 may operate in a digital driving scheme.

According to another example, the display panel 110 may operate in an analog driving scheme. In this case, in response to the gate signal received through the gate lines GL1 to GLn, the pixels PX may emit light at brightness corresponding to levels of data voltages or levels of currents respectively received through the source lines SL1 to SLm. For illustrative purposes only, exemplary embodiments of the organic light-emitting display apparatus 100 operating in the digital driving scheme are described. However, other embodiments of the organic light-emitting display apparatus may operate in the analog driving scheme.

As illustrated in FIG. 1, the power wire network may include a power transfer line PTL, a power input line PIL, a connection part CN, and first and second power wires PW1 and PW2. The power transfer line PTL extends in a first direction and transfers the first source voltage ELVDD. The power input line PIL extends in the first direction and applies the first source voltage ELVDD. The connection part CN transfers the first source voltage ELVDD from the power transfer line PTL to the power input line PIL. The first and second power wires PW1 and PW2 extend in a second direction (e.g., outside the display area DA) and supply the first source voltage ELVDD to the power input line PIL.

The first and second power wires PW1 and PW2 may be outside the display area DA in the second direction, which perpendicularly intersects the first direction in which the power input line PIL extends. The first power voltage ELVDD generated by the source voltage generator 150 may be directly applied to the first and second power wires PW1 and PW2. Since the first and second power wires PW1 and PW2 have a lower line resistance than that of the power input line PIL, voltage drop caused by current flow is small to be negligible. FIG. 1 illustrates that the first power wire PW1 may be disposed above the display area DA, and the second power wire PW2 may be disposed below the display area DA. In another embodiment, one or both of the power wires may be disposed on a left side and/or a right side of the display area DA, respectively on both sides, or may be disposed to surround the display area DA.

In FIG. 1, only one power input line PIL is illustrated. In another embodiment, a plurality of power input lines PIL may be arranged in the display panel 110 and connected to at least one of the first or second power wires PW1 and PW2. As illustrated in FIG. 1, the power input lines PIL may be connected between the first and second power wires PW1 and PW2. Each of the power input lines PIL may have a first end connected to the first power wire PW1 and a second end connected to the second power wire PW2. When one of the first and second power wires PW1 and PW2 is omitted, each of the power input lines PIL may be connected to the other power wire. When a power wire is disposed on the left side and/or the right side of the display area DA, the power input lines PIL may extend in a row direction (a horizontal direction in FIG. 1). When the power wire is disposed to surround the display area DA, the power input lines PIL may be arranged in a mesh form. In one embodiment, the power input lines PIL may be disposed across a whole portion of the display area DA and may be directly connected to the first and second power wires PW1 and PW2, so as to be connected to all the pixels PX from a pixel of a first row to a pixel of a last row in the display area DA.

In FIG. 1, only one power transfer line PTL is illustrated. In another embodiment, a plurality of power transfer lines PTL may be arranged in the display panel 110 and may not be directly connected to the pixels PX, unlike the power input lines PIL. As illustrated in FIG. 1, the power transfer lines PTL may extend in a column direction (a vertical direction in FIG. 1). In another embodiment, the power transfer lines PTL may extend in the row direction or may be arranged in a mesh form. In one embodiment, the power transfer lines PTL may be disposed across the whole portion of the display area DA and may be directly connected to the first and second power wires PW1 and PW2.

The connection part CN may electrically connect the power input line PIL to the power transfer line PTL. The connection part CN may be connected to a middle portion of the power transfer line PTL and the power input line PIL. In one embodiment, the middle portion of each of the power input lines PIL may correspond to a portion adjacent to a center point of the power transfer line PTL along a lengthwise direction of the power input line PIL.

According to an exemplary embodiment illustrated in FIG. 1, the first source voltage ELVDD generated by the source voltage generator 150 may be applied to the first and second power wires PW1 and PW2 and may be applied to the pixels PX through the power input line PIL. In another embodiment, the first source voltage ELVDD may be applied to the first and second power wires PW1 and PW2 and may be applied to the pixels PX through the power transfer line PTL, the connection part CN, and the power input line PIL. Therefore, a current I flowing through the power input line PIL may flow from the first and second power wires PW1 and PW2 to a center point of the power input line PIL.

Also, the current I flowing through the power transfer line PTL may flow from the center point of the power input line PIL to the first power wire PW1 or the second power line PW2 via the connection part CN from the first and second power wires PW1 and PW2.

Since the power transfer line PTL and the power input line PIL have a resistance component, a voltage drop may occur based on a current which flows through the power transfer line PTL and the power input line PIL. Due to the voltage drop, the level of a voltage, which is applied to a pixel PX1 closest to the first power wire PW1 or a pixel PX3 closest to the second power wire PW2 among a plurality of pixels PX connected to the power input line PIL, may be higher than that of a voltage applied to a plurality of pixels PX2 and PX4 disposed close to the connection part CN.

The second source voltage ELVSS generated by the source voltage generator 150 may be applied to the pixels PX through a common electrode. The common electrode may correspond to one electrode (for example, a cathode electrode) of a light-emitting device of each of the pixels PX, and all the pixels PX may be connected to the common electrode. The common electrode may be provided to completely cover the pixels PX in the display area DA. The second source voltage ELVSS may be applied from an outer portion of the display area DA to the common electrode. Since a voltage level of the second source voltage ELVSS is lower than that of the first source voltage ELVDD, a current supplied to each of the pixels PX may leak to the source voltage generator 150 through the common electrode. Therefore, a voltage level at an outer portion of the common electrode to which the second source voltage ELVSS is applied may be lower than a voltage level at a center portion of the common electrode. For example, a current may flow from the center portion of the common electrode to the outer portion of the common electrode.

Similarly to the first source voltage ELVDD in the exemplary embodiment of FIG. 1, the second source voltage ELVSS may be applied from the upper edge and the lower edge of the display area DA to the common electrode. In another embodiment, the second source voltage ELVSS may be applied from at least one of the upper edge, power end, left side, or right side of the display area DA to the common electrode.

Figure 2:
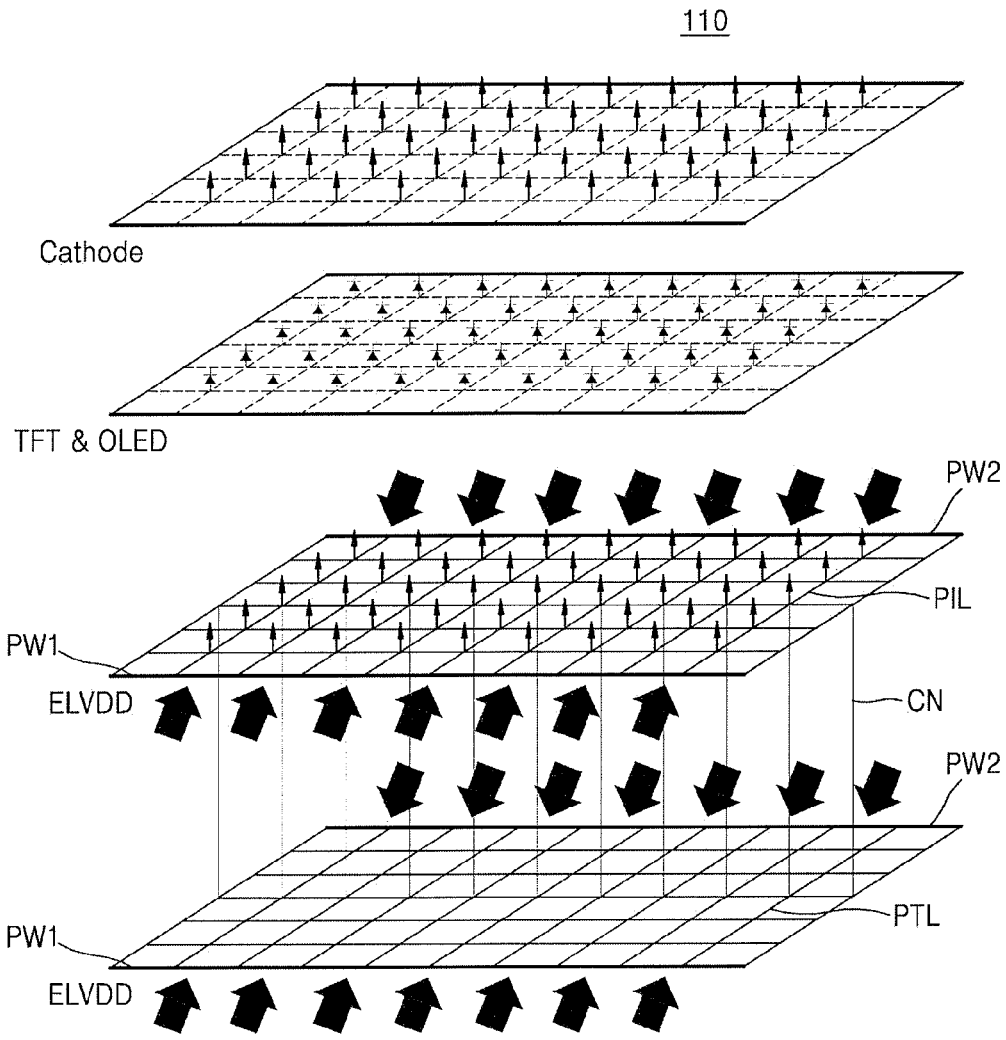
FIG. 2 illustrates an embodiment of a display panel.

FIG. 2 illustrating an example of a configuration of the display panel 110 in the organic light-emitting display apparatus 100 of FIG. 1. Referring to FIG. 2, the display panel 110 includes the power input line PIL, the power transfer line PTL, and the first and second power wires PW1 and PW2. Also, the display panel 110 includes an organic light-emitting device OLED, which receives a source voltage to emit light, and one or more thin film transistors TFT that supply the source voltage to the organic light-emitting device OLED.

The power transfer line PTL may extend in the first direction and receives the first source voltage ELVDD through the first and second power wires PW1 and PW2. Also, the power transfer line PTL may be connected to a middle point of the power input line PIL through the connection part CN and may transfer the first source voltage ELVDD to the power transfer line PTL. As illustrated in FIG. 2, a plurality of power transfer line PTL may be provided. The number of power transfer lines PTL may be different depending, for example, on the total number of pixels in and the size of the display panel 110.

The power input line PIL may extend in the first direction, like the power transfer line PTL, and receives the first source voltage ELVDD through the first and second power wires PW1 and PW2. Also, the power input line PIL may be connected to the power transfer line PTL at a middle point of the power input line PIL and may receive the first source voltage ELVDD through the power transfer line PTL.

The first and second power wires PW1 and PW2 may extend in the second direction. The first and second power wires PW1 and PW2 may be connected to the source voltage generator 150. The first source voltage ELVDD from the source voltage generator 150 may be applied to the first and second power wires PW1 and PW2. The first and second power wires PW1 and PW2 may be directly connected to the power transfer line PTL and the power input line PIL. The first source voltage ELVDD may be applied to the power transfer line PTL and the power input line PIL through the first and second power wires PW1 and PW2.

A current flowing through the power input line PIL may flow to the pixels PX due to the first source voltage ELVDD applied to the power input line PIL. The current supplied to each of the pixels PX may flow through a pixel circuit including the thin film transistor TFT and an anode and a cathode of the organic light-emitting device OLED.

The pixels PX may be directly connected to the power input line PIL, and the first source voltage ELVDD may be applied to the pixels PX through the power input line PIL. As illustrated in FIG. 2, the pixels PX may not be directly connected to the power transfer line PTL. Depending on the location connected to the power input line PIL, the pixels PX may receive the first source voltage ELVDD directly supplied from the first power wire PW1 or the second power wire PW2 to the power input line PIL.

In another embodiment, depending on the location connected to the power input line PIL, the pixels PX may receive the first source voltage ELVDD transferred through the power transfer line PTL, the connection part CN, and the power input line PIL from the first power wire PW1 or the second power wire PW2. Therefore, the first source voltage ELVDD supplied to the pixels PX may have different levels for each of the pixels PX.

For example, the level of the first source voltage ELVDD supplied to a pixel PX close to the first power wire PW1 or the second power wire PW2 may be higher than that of the first source voltage ELVDD supplied to a pixel PX close to the connection part CN. This is because the first source voltage ELVDD is supplied to the pixel PX, which is disposed close to the first power wire PW1 or the second power wire PW2, through the power input line PIL from the first power wire PW1 or the second power wire PW2. However, the first source voltage ELVDD is supplied to the pixel PX, which is disposed close to the connection part CN, via the power transfer line PTL, the connection part CN, and the power input line PIL from the first power wire PW1 or the second power wire PW2. A voltage drop may therefore occur due to resistance components of the power transfer line PTL, the power input line PIL, and the connection part CN. For this reason, the level of the first source voltage ELVDD is changed depending on the location of the pixels PX.

In FIG. 2, the first power wire PW1 connected to the power input line PIL and the first power wire PW1 connected to the power transfer line PTL are separately illustrated. However, it may be understood that the first power wire PW1 may be connected to the power input line PIL and the power transfer line PTL in common and is substantially the same wire. Also, the second power wire PW2 connected to the power input line PIL and the second power wire PW2 connected to the power transfer line PTL are separately illustrated. However, it may be understood that the second power wire PW2 may be connected to the power input line PIL and the power transfer line PTL in common and is substantially the same wire.

In FIG. 2, the cathode may be an electrode from which a current flowing in a pixel PX is output, and may be provided as the common electrode to cover all the pixels PX. Also, the second source voltage ELVSS generated by the source voltage generator 150 may be applied to the cathode.

The first and second power wires PW1 and PW2 may be outside the display area DA of the display panel 110. A portion of the power input line PIL and a portion of the power transfer line PTL may be in the display area DA. Another portion of the power input line PIL and another portion of the power transfer line PTL may be outside the display area DA. The display area DA may also include the pixels PX.

As illustrated in FIG. 2, the first source voltage ELVDD may be applied from the first and second power wires PW1 and PW2 to the plurality of power input lines PIL and the plurality of power transfer lines PTL. A voltage drop, which occurs along a lengthwise direction of each of the first and second power wires PW1 and PW2, may be small to negligible. Therefore, voltages applied to the first and second power wires PW1 and PW2 may be the same along a lengthwise direction. Also, the levels of the first source voltage ELVDD applied to the power input lines PIL and the power transfer line PTL may be the same irrespective of location.

Figure 3:
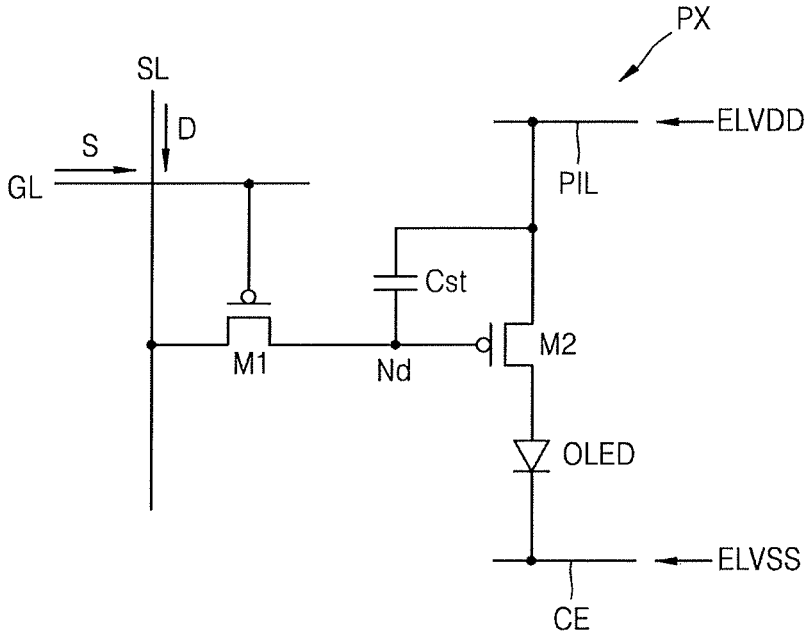
FIG. 3 illustrates an embodiment of a pixel.

FIG. 3 illustrates an embodiment of a pixel PX which is connected to a gate line GL of the same row and a source line SL of the same column. The pixel PX includes a pixel circuit and a light-emitting device. The pixel circuit includes a first transistor M1, a second transistor M2, and a storage capacitor Cst. The light-emitting device includes an organic light-emitting device OLED.

Each of the first and second transistors M1 and M2 may be a thin film transistor (TFT). The first transistor M1 includes a first connection terminal connected to the source line SL, a second terminal connected to a node Nd, and a control terminal connected to the gate line GL. The second transistor M2 includes a first connection terminal connected to the power input line PIL to which the first source voltage ELVDD is applied, a control terminal connected to the node Nd, and a second connection terminal connected to a first electrode of the organic light-emitting device OLED. The storage capacitor Cst may include a first terminal connected to the first connection terminal of the second transistor M, and a second terminal connected to the node Nd.

The organic light-emitting device OLED includes the first electrode connected to the second connection terminal of the second transistor M2 and a second electrode connected to a common electrode CE to which the second source voltage ELVSS is applied. The first electrode of the organic light-emitting device OLED may be an anode electrode, and the second electrode of the organic light-emitting device OLED may be a cathode electrode.

The pixel PX receives a scan signal S through the gate line GL and receives a data signal D through the source line SL. The first transistor M1 transfers the data signal D to the control terminal of the second transistor M2 in response to the scan signal S. The second transistor M2 may be turned on or off according to a logic level of the transferred data signal D. When the second transistor M2 is turned on, the second transistor M2 may transfer the first source voltage ELVDD to the first electrode of the organic light-emitting device OLED. The storage capacitor Cst may maintain a turn-on state or a turn-off state of the second transistor M2 based on the logic level of the data signal D during a subfield time period. For example, when the digital data signal D has a first logic level, the first source voltage ELVDD may be applied to the first electrode of the organic light-emitting device OLED, and the organic light-emitting device OLED may emit light. When the digital data signal D has a second logic level, the second transistor M2 may be turned off, and thus, the first source voltage ELVDD may not be applied to the first electrode of the organic light-emitting device OLED. Thus, the organic light-emitting device OLED may not emit light. In another embodiment, the pixel PX may have a different configuration.

Figure 4A:
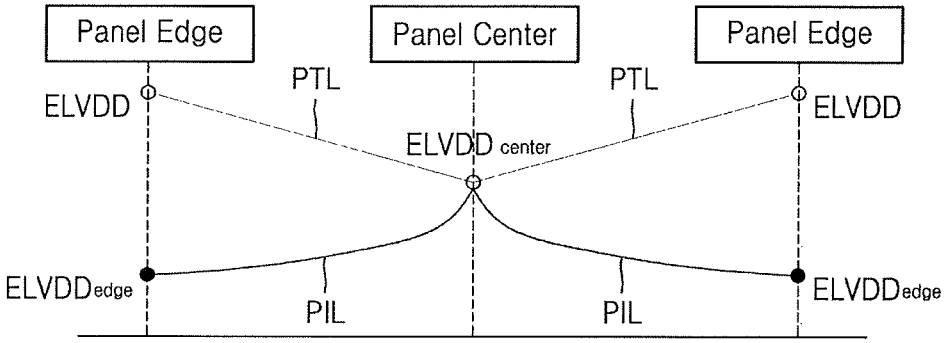
FIGS. 4(*a*) and 4(*b*) illustrate examples of voltage drop.
Figure 4B:
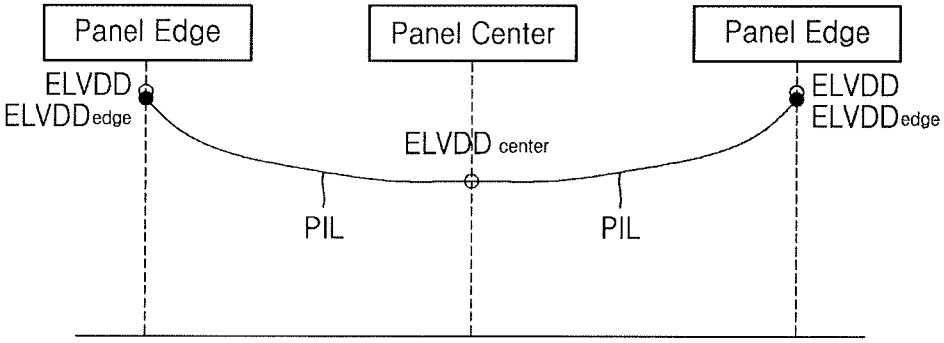

FIGS. 4(*a*) and 4(*b*) illustrate examples of a voltage drop when a source voltage is applied through only one of a power input line or a power transfer line. In FIGS. 4(*a*) and 4(*b*), a panel edge indicates a location where the first power wire PW1 or the second power wire PW2 is disposed, and a panel center indicates a center point of the first power wire PW1 and the second power wire PW2. The panel edge may be a location to which a source voltage from the source voltage generator 150 is directly supplied through the first power wire PW1 or the second power wire PW2, and thus may have a highest voltage level among source voltages supplied to the display panel 110. The source voltage denotes the first source voltage ELVDD.

FIG. 4(*a*) illustrates a voltage drop when a source voltage is applied through only the power transfer line PTL of the display panel 110 described above with reference to FIGS. 1 and 2. When the source voltage is applied through only the power transfer line PTL, the first source voltage ELVDD may be applied through the power transfer line PTL, the connection part CN, and the power input line PIL. Thus, due to voltage drop, the first source voltage ELVDD having a relatively low level may be applied to a pixel PX close to the first power wire PW1 or the second power wire PW2 among a plurality of pixels PX 6 connected to the power input line PIL. The notation $ELVDD_{edge}$ denotes a first source voltage which is supplied to a pixel PX closest to the first power wire PW1 or the second power wire PW2 among a plurality of pixels PX.

Due to a resistance component of the power transfer line PTL, the level of the first source voltage ELVDD supplied through the first power wire PW1 or the second power wire PW2 is reduced, while being transferred to the connection part CN connected to a middle point of the power input line PIL through the power transfer line PTL. Also, the first source voltage ELVDD supplied to the power input line PIL through the connection part CN may be continuously reduced at the middle point of the power input line PIL, while being supplied to the pixels PX along a lengthwise direction. In this case, the level of the first source voltage ELVDD may be nonlinearly reduced due to resistance components of the organic light-emitting device and the pixel circuit connected to the power input line PIL.

Also, in FIG. 4(*a*), the magnitude of voltage drop which occurs in the display panel 110 may be defined as $ELVDD-ELVDD_{edge}$.

FIG. 4(*b*) shows voltage drop when a source voltage is applied through only the power input line PIL of the display panel 110 described above with reference to FIGS. 1 and 2. When the source voltage is applied through only the power input line PIL, the first source voltage ELVDD may not be applied through the power transfer line PTL and the connection part CN. Thus, due to voltage drop, the first source voltage ELVDD having a relatively low level may be applied to a pixel PX close to the connection part CN among a plurality of pixels PX connected to the power input line PIL.

Due to a resistance component of the power input line PIL, the level of the first source voltage ELVDD supplied through the first power wire PW1 or the second power wire PW2 is progressively reduced while being transferred through the power input line PIL. Also, a level of the first source voltage ELVDD supplied through the power input line PIL may be nonlinearly reduced due to the resistance components of the organic light-emitting device and the pixel circuit connected to the power input line PIL.

Also, in FIG. 4(*b*), the magnitude of voltage drop which occurs in the display panel 110 may be defined as $ELVDD-ELVDD_{center}$, where $ELVDD_{center}$ denotes the level of a voltage applied to the connection part CN.

When the first source voltage ELVDD is supplied through only the power input line PIL, a current flowing to the power transfer line PTL may not be generated. Thus, voltage drop caused by the power transfer line PTL may not be considered.

Figure 5:
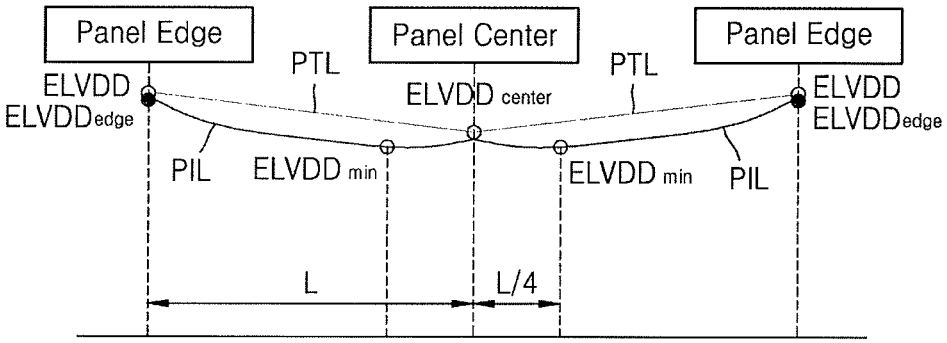
FIG. 5 illustrates examples of voltage drop in according to one embodiment.

FIG. 5 illustrates an example of voltage drop in the display panel 110 according to an exemplary embodiment. As described above with reference to FIGS. 1 and 2, in the display panel 110 the power input line PIL and the power transfer line PTL may be connected to the first power wire PW1 or the second power wire PW2. Also, the first source voltage ELVDD may be applied to the power input line PIL and the power transfer line PTL.

Referring to FIG. 5, the level of the first source voltage ELVDD supplied through the power transfer line PTL is linearly reduced by a resistance component of the power transfer line PTL, while the first source voltage ELVDD is being transferred from the panel edge to the panel center. Also, the level of the first source voltage ELVDD, which is supplied to the pixel PX through the power transfer line PTL, the connection part CN, and the power input line PIL, is reduced along the lengthwise direction of the power input line PIL from the center point of the power input line PIL, namely, the connection part CN. However, since the power input line PIL receives the first source voltage ELVDD from the first power wire PW1 or the second power wire PW2 as well as the power transfer line PTL, the level of the first source voltage ELVDD supplied through the power input line PIL again increases toward the panel edge.

In FIG. 5, the magnitude of voltage drop which occurs in the display panel 110 may be defined as $ELVDD-ELVDD_{min}$. The location corresponding to $ELVDD_{min}$ may be calculated based on Equation (1).

$$\text{Location} = \frac{L}{2(1+a)} \tag{1}$$

where L denotes a distance from the panel center to the panel edge, and a denotes a ratio of a resistance value of the power transfer line to a resistance value of the power input line.

FIG. 5 illustrates a case (e.g., a case where a=1) where the resistance value of the power transfer line is the same as that of the power input line. In FIG. 5, the location where a level of the supplied first source voltage ELVDD is the minimum ($ELVDD_{min}$) is L/4.

As shown in FIG. 4*a*), when the first source voltage ELVDD is supplied through only the power transfer line PTL, the value "$ELVDD-ELVDD_{center}$" may be defined as $V_D$. Thus, the value "$ELVDD_{center}-ELVDD_{edge}$" may be calculated as $V_D/2$. Therefore, in FIG. 4(*a*), voltage drop may be $3V_D/2$.

Moreover, it may be understood that voltage drop in the display panel 110 according to an exemplary embodiment is calculated as $9V_D/32$, as shown in FIG. 5, and the display panel 100 has voltage drop of about 19%, compared to the case shown in FIG. 4(*a*).

As the voltage drop value increases, a larger compensation margin may be required for image data. When the compensation margin is large (e.g., above a predetermined value), compensation time increases. Thus, an emission duty cycle may be relatively or proportionately reduced. Therefore, the level of a source voltage may increase for emitting light at a sufficient luminance for a short time. When a higher source voltage is supplied, power consumption increases.

Moreover, in generating compensation data for compensating voltage drop, as the voltage drop value increases (e.g., as a deviation of a source voltage applied to a plurality of pixels increases), the probability that an error will occur in generating the compensation data increases.

To solve such problems, a voltage drop value may be reduced. Also, the display panel 110 according to an exemplary embodiment may supply a source voltage through the power input line and the power transfer line, thereby decreasing a source voltage deviation between a plurality of pixels caused by voltage drop.

Figure 6A:
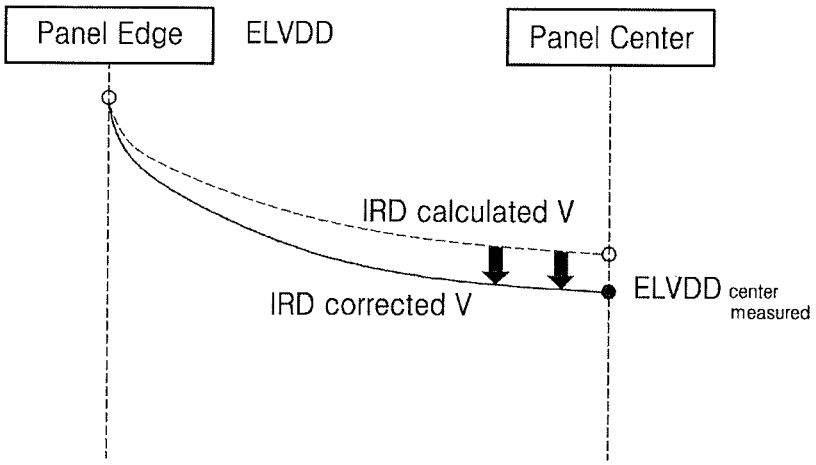
FIGS. 6(*a*) and 6(*b*) illustrate an embodiment of a method for compensating voltage drop.
Figure 6B:
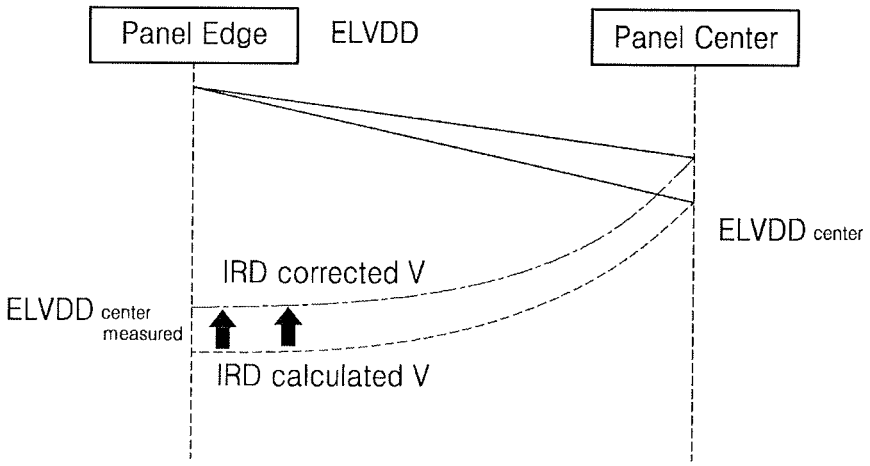

FIGS. 6(*a*) and 6(*b*) illustrating an embodiment of a method for compensating voltage drop in an organic light-emitting display panel. In FIGS. 6(*a*) and 6(*b*), the panel edge denotes the first power wire PW1 or the second power wire PW2, and the panel center denotes a center point of the first power wire PW1 and the second power wire PW2.

FIG. 6(*a*) shows that when the power transfer line PTL is disconnected from the first power wire PW1 and the second power wire PW2 and the first source voltage ELVDD is supplied through the power input line PIL, the voltage at the panel center is measured. A voltage illustrated as a dashed line denotes a voltage (IRD calculated V) in which voltage drop calculated based on resistance components of the power input line PIL and the power transfer line PTL is reflected. Also, a voltage illustrated as a solid line denotes a corrected voltage (IRD corrected V) in which a voltage value obtained by measuring a panel center voltage is reflected. For example, the voltage (IRD corrected V) illustrated as the solid line denotes a predicted voltage. Here, the panel center voltage $ELVDD_{center}$ may be obtained by measuring a voltage applied to the power transfer line PTL, instead of measuring the panel center voltage. Therefore, a current flowing to the power transfer line PTL does not occur, and a resistance of the connection part CN that connects the power transfer line PTL to the power input line PIL is negligible. Accordingly, the level of the panel center voltage $ELVDD_{center}$ is almost equal to that of a voltage applied to the power transfer line PTL.

The difference between the panel center voltage $ELVDD_{center}$ and a voltage (hereinafter referred to as ELVDD) measured from the panel edge may be defined based on Equation (2).

$$ELVDD - ELVDD_{center} = \frac{V_D}{2a} \tag{2}$$

where a denotes a ratio of a resistance value of the power transfer line to a resistance value of the power input line.

FIG. 6(*b*) shows that when the power input line PIL is disconnected from the first power wire PW1 and the second power wire PW2 and the first source voltage ELVDD is supplied through the power transfer line PTL, the voltage at the panel edge is measured. Since it may be difficult to measure the panel center voltage $ELVDD_{center}$ without a separate measurement line, the voltage at the panel edge may be measured, and a level of a source voltage applied to the power transfer line PTL may be corrected by reflecting a difference between a predicted voltage (IRD calculated V) and the measured voltage.

The difference between the first source voltage ELVDD and the panel center voltage $ELVDD_{center}$ and a difference between the panel center voltage $ELVDD_{center}$ and the panel edge voltage $ELVDD_{edge}$ may be determined based on Equation (3)

$$ELVDD - ELVDD_{center} = V_D \tag{3}$$

$$ELVDD_{center} - ELVDD_{edge} = \frac{V_D}{2a}$$

where a denotes a ratio of a resistance value of the power transfer line to a resistance value of the power input line.

Equation (4) may be obtained from Equations (2) and (3).

$$ELVDD - ELVDD_{edge} = \frac{V_D}{2a} + V_D \tag{4}$$

where the left term denotes a value which is known through direct measurement, and a first order of the right term denotes a value which is known through direct measurement as in Equation (2). Therefore, the value "$V_D$" may be calculated. Also, the value "a" may be calculated by substituting the calculated value "$V_D$" into Equation (2) or (4).

As described above, the value "a" denotes the ratio of a resistance value of the power transfer line to a resistance value of the power input line. Since the resistance components of the power input line and the power transfer line are the largest factors causing voltage drop, the ratio (e.g., the value "a") becomes a variable that may be used to calculate a voltage drop compensation value in the display panel. Therefore, an actual value "a" may be calculated through the method in FIG. 6, and the accuracy of voltage drop compensation may be enhanced by reflecting the calculated actual value "a".

Figure 7:
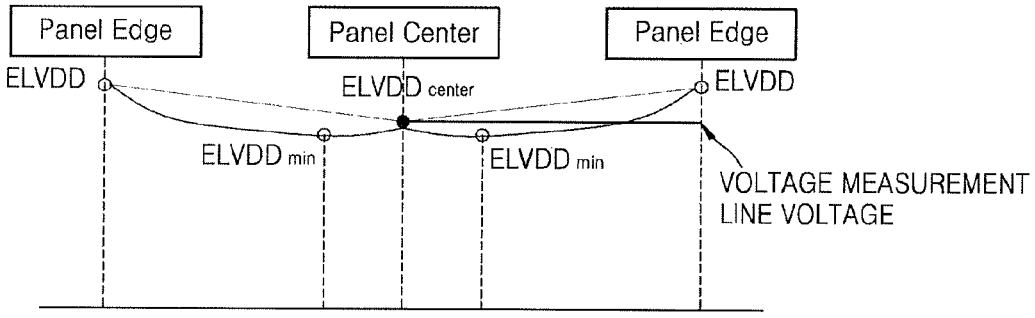
FIG. 7 illustrates another embodiment of a method for compensating voltage drop.

FIG. 7 illustrates another embodiment of a method for compensating voltage drop in an organic light-emitting display panel. In FIG. 7, a voltage change curve is the same as a voltage change curve in FIG. 5.

The voltage drop compensating method in FIG. 7 may directly measure a panel center voltage $ELVDD_{center}$ through a voltage measurement line used to measure the panel center voltage $ELVDD_{center}$. The difference between the first source voltage ELVDD and the panel center voltage $ELVDD_{center}$ may be based on Equation (5)

$$ELVDD - ELVDD_{edge} = \frac{aV_D}{2(a+1)} \tag{5}$$

where $V_D$ denotes a voltage which is calculated by using a resistance of the power transfer line and a current flowing through the power input line, and a denotes a ratio of a resistance value of the power transfer line to a resistance value of the power input line.

The resistance of the power transfer line may be calculated using the level of a current, which flows from the first power wire PW1 or the second power wire PW2 to the connection part CN, and the potential difference between the first source voltage ELVDD and the panel center voltage $ELVDD_{center}$. Also, the level of a current flowing through the power input line PIL may have the same value as a total sum of currents which respectively flow in the pixels PX in the display panel.

A variety of methods may be used to measure the level of current. For example, a method may be used which measures and sums levels of currents respectively input to the pixels PX, or a method may be used which measures and sums levels of currents which respectively flow in the power input lines PIL.

In Equation (5), $V_D$ of a left term and $V_D$ of a right term may be calculated by direct measurement. Thus, the value "a" in Equation (5) may be calculated. As shown in FIG. 6, the actual value "a" may be calculated and reflected, thereby enhancing the accuracy of voltage drop compensation. Moreover, the location where the first source voltage is minimum may be calculated by substituting the calculated actual value "a" into Equation (1).

Figure 8:
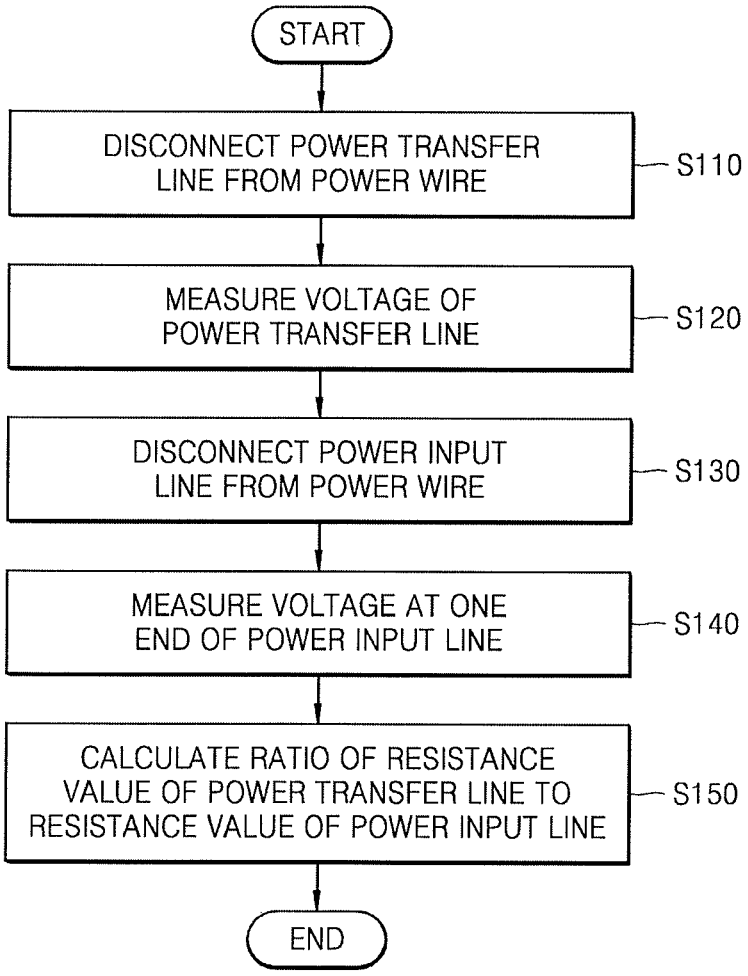
FIG. 8 illustrates operations included in an embodiment of a voltage drop compensating method.

FIG. 8 is a flowchart illustrating operations included in one embodiment of a voltage drop compensating method for an organic light-emitting display panel. The display panel may include a power input line which extends in a first direction and through which a source voltage is applied, a power transfer line which extends in the first direction and is connected to a center point of the power input line to transfer the source voltage to the power input line, and first and second power wires which supply the source voltage to the power input line and the power transfer line. The organic light-emitting display panel may correspond, for example, to the display panel 100.

Referring to FIG. 8, the method includes a first operation S110 of disconnecting the power transfer line from the first and second power wires, second operation S120 of measuring a level of a voltage applied to the power transfer line, third operation S130 of connecting the first and second power wires to the power transfer line and disconnecting the first and second power wires from the power input line, fourth operation S140 of measuring a level of a voltage at one end of the power input line, and fifth operation S150 of calculating a ratio of a resistance value of the power transfer line to a resistance value of the power input line.

The flowchart of FIG. 8 corresponds to the method of FIG. 6. First operation S110 denotes the source voltage supplied through only the power input line. In second operation S120, it may be understood that measuring the level of a voltage applied to the power transfer line is to perform the same measurement as measurement of a panel center voltage. Therefore, the value expressed in Equation (2) may be calculated through first operation S110 and second operation S120.

Operation S130 denotes the source voltage supplied through only the power transfer line. In fourth operation S140, it may be understood that measuring a voltage at one end of the power input line is to measure a panel edge voltage. Therefore, the value expressed in Equation (3) may be calculated through third operation S130 and fourth operation S140.

In fifth operation S150, the ratio may be calculated based on a difference between the source voltage and the voltage measured through second operation S120 and a difference between the source voltage and the voltage measured through fourth operation S140. For example, in fifth operation S150, the ratio (the value "a" in Equations (2) to (4)), namely, the ratio of a resistance value of the power transfer line to a resistance value of the power input line, may be calculated by substituting the values calculated through Equations (2) and (3) into Equation (4).

The ratio calculated through an actual measurement may be applied to a voltage drop compensating equation obtained by reflecting a resistance component of the organic light-emitting display panel, thereby enhancing accuracy of voltage drop compensation.

Figure 9:
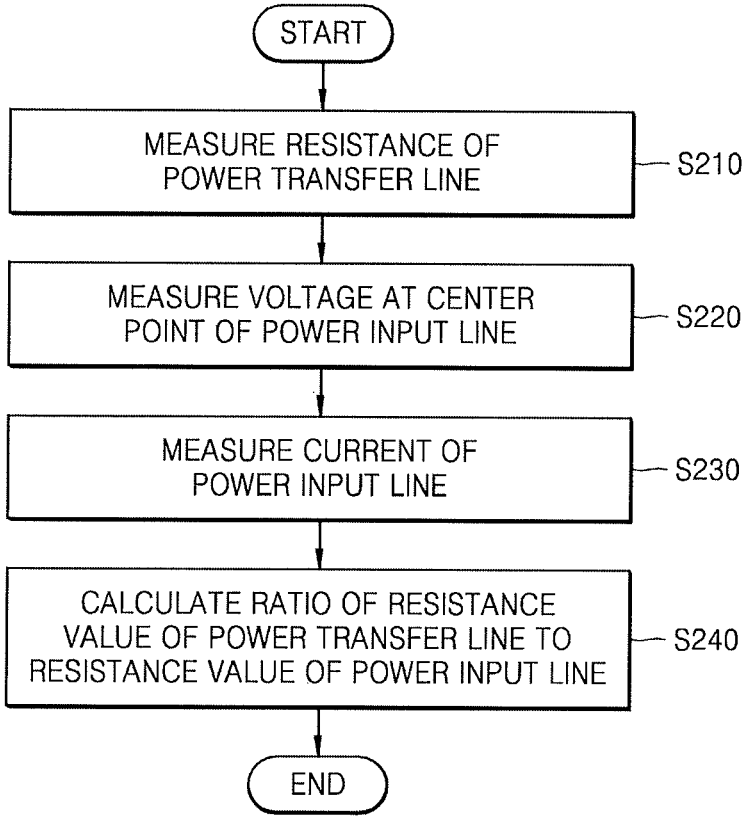
FIG. 9 illustrates operations included in another embodiment of a voltage drop compensating method.

FIG. 9 is a flowchart illustrating another embodiment of a voltage drop compensating method for an organic light-emitting display panel, organic light-emitting display panel includes a power input line which extends in a first direction and through which a source voltage is applied, a power transfer line which extends in the first direction and is connected to a center point of the power input line to transfer the source voltage to the power input line, a voltage measurement line that measures a voltage at the center point of the power input line, and first and second power wires which supply the source voltage to the power input line and the power transfer line. The organic light-emitting display panel may be, for example, the display panel 100.

Referring to FIG. 9, the method includes an operation S210 of measuring a resistance of the power transfer line, operation S220 of measuring a voltage at the center point of the power input line by using the voltage measurement line, operation S230 of measuring a level of a current which flows through the power input line, and operation S240 of calculating a ratio of a resistance value of the power transfer line to a resistance value of the power input line.

In operation S210, the resistance of the power transfer line may be calculated based on a level of current, which flows from the first or second power wire to a center point of the power transfer line, and a potential difference between the first source voltage ELVDD and the panel center voltage $ELVDD_{center}$. A different resistance measurement method may be used in another embodiment.

In operation S220, the voltage at the center point (e.g., a point where the power input line is connected to the power transfer line) of the power input line may be directly measured using the voltage measurement line. The voltage measured through operation S220 may be the panel center voltage described above with reference to FIGS. 6 and 7.

In operation S230, the level of current flowing in the power input line may be measured by summing all currents which respectively flow in a plurality of pixels in the organic light-emitting display panel. In one embodiment, a method of measuring and summating all levels of currents flowing in a plurality of the power input lines may be used.

In operation S240, the ratio may be calculated based on Equation (6)

$$ELVDD - ELVDD_{center} = \frac{aV_D}{2(a+1)} \tag{5}$$

where ELVDD denotes the source voltage, $ELVDD_{center}$ denotes the voltage measured through operation S220, $V_D$ denotes a voltage which is calculated by using a resistance of the power transfer line and the current measured through operation S230, and a denotes the ratio.

In Equation (6), $V_D$ may be calculated by multiplying the resistance value measured through operation S210 and the current value measured through operation S230. As a result, the ratio (the value "a") in Equation (6) may be calculated. Also, the ratio (the value "a") calculated through an actual measurement may be applied to a voltage drop compensating equation which is obtained by reflecting a resistance component of the organic light-emitting display panel, thereby enhancing the accuracy of voltage drop compensation.

According to the one or more of the above exemplary embodiments, an organic light-emitting display panel, an organic light-emitting display apparatus, and a voltage drop compensating method decrease luminance deviation caused by a voltage drop of a source voltage line.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. An organic light-emitting display panel, comprising:

a power input line extending in a first direction of a display area, the power input line to apply a first source voltage;

a power transfer line extending in the first direction and connected to a center point of the power input line by a connection line in the display area, the power transfer line to transfer the first source voltage to the power input line through only the connection line;

a first power wire and a second power wire extending in a second direction outside the display area, the first power wire and the second power wire to supply the first source voltage to the power input line and the power transfer line; and a plurality of pixels arranged in a matrix in the display area and connected to the power input line to receive the first source voltage through the power input line, wherein the pixels are indirectly connected to the power transfer line and directly connected only to the power input line.

2. The panel as claimed in claim 1, wherein a level of the first source voltage, which is supplied to a plurality of pixels arranged closest to the first power wire or the second power wire, is higher than a level of the first source voltage supplied to a plurality of pixels connected to the center point of the power input line.

3. The panel as claimed in claim 1, wherein the power input line is electrically connected to the power transfer line through a connection part.

4. The panel as claimed in claim 1, wherein the pixels are to be supplied with a second source voltage having a lower voltage level than a level of the first source voltage.

5. The panel as claimed in claim 4, wherein each of the pixels includes:

a pixel circuit; and a light-emitting device that includes a first electrode connected to the pixel circuit and a second electrode to which the second source voltage is applied.

6. The panel as claimed in claim 5, wherein:

the first electrode is an anode electrode, and the second electrode is a cathode electrode.

7. The panel as claimed in claim 5, wherein the pixel circuit includes:

a first thin film transistor to be turned on by a scan signal applied through a gate line and to transfer a data signal applied through a source line;

a second thin film transistor to be turned on according to a logic level of the data signal and to transfer the first source voltage to the light-emitting device; and a capacitor to maintain a turn-on state or a turn-off state of the second thin film transistor based on a logic level of the data signal during a subfield time period.

8. An organic light-emitting display apparatus, comprising:

a source voltage generator to generate a first source voltage and a second source voltage having a lower voltage level than a level of the first source voltage; and an organic light-emitting display panel which includes:

a power input line extending in a first direction of a display area, the power input line to apply a first source voltage;

a power transfer line extending in the first direction and connected to a center point of the power input line by a connection line in the display area, the power transfer line to transfer the first source voltage to the power input line through only the connection line;

a first power wire and a second power wire extending in a second direction outside the display area, the first power wire and the second power wire to supply the first source voltage to the power input line and the power transfer line; and a plurality of pixels arranged in a matrix form in the display area and connected to the power input line to receive the first source voltage through the power input line, wherein the pixels are indirectly connected to the power transfer line and directly connected only to the power input line.

9. A voltage drop compensating method for an organic light-emitting display panel that includes a power input line extending in a first direction and through which a source voltage is applied, a power transfer line extending in the first direction and connected to a center point of the power input line to transfer the source voltage to the power input line, and first and second power wires which supply the source voltage to the power input line and the power transfer line, the voltage drop compensating method comprising:

disconnecting the power transfer line from the first and second power wires;

measuring a level of a voltage applied to the power transfer line;

connecting the first and second power wires to the power transfer line and disconnecting the first and second power wires from the power input line;

measuring a level of a voltage at one end of the power input line; and calculating a ratio of a resistance value of the power transfer line to a resistance value of the power input line.

10. The method as claimed in claim 9, wherein calculating the ratio includes:

calculating the ratio based on a difference between the source voltage and the voltage, which is measured in measuring the level of the voltage applied to the power transfer line, and a difference between the source voltage and the voltage which is measured in measuring the level of the voltage at the one end of the power input line.

11. A voltage drop compensating method for an organic light-emitting display panel that includes a power input line extending in a first direction and through which a source voltage is applied, a power transfer line extending in the first direction and is connected to a center point of the power input line to transfer the source voltage to the power input line, a voltage measurement line that measures a voltage at the center point of the power input line, and first and second power wires which supply the source voltage to the power input line and the power transfer line, the voltage drop compensating method comprising:

measuring a resistance of the power transfer line;

measuring the voltage at the center point of the power input line using the voltage measurement line;

measuring a level of a current which flows through the power input line; and calculating a ratio of a resistance value of the power transfer line to a resistance value of the power input line.

12. The method as claimed in claim 11, wherein calculating the ratio includes:

calculating the ratio based on the following Equation:

$$ELVDD - ELVDD_{center} = \frac{aV_D}{2(a+1)}$$

where ELVDD denotes the source voltage, $ELVDD_{center}$ denotes the voltage measured in measuring the voltage, $V_D$ denotes a voltage calculated using a resistance of the power transfer line and the current measured in measuring the level of the current, and a denotes the ratio.

* * * * *